428-919 SR
8/15/78 XR 4,106,124

United States Patent [19]

Green

[11] 4,106,124

[45] Aug. 15, 1978

[54] SNAGPROOF HELMUT CAMOUFLAGE COVER

[75] Inventor: Charles Emmons Green, Deland, Fla.

[73] Assignee: Brunswick Corporation, Skokie, Ill.

[21] Appl. No.: 775,925

[22] Filed: Mar. 9, 1977

[51] Int. Cl.[2] ..... A42B 1/24; A42C 5/00

[52] U.S. Cl. ..... 2/187; 2/422; 428/919; 428/17; 132/53

[58] Field of Search ..... 2/187, 6, 422, 185 R, 2/186, 198, 199; 428/15, 17, 919; 132/53, 56; 46/172

[56] References Cited

U.S. PATENT DOCUMENTS

| | | | |
|---|---|---|---|
| 2,911,652 | 11/1959 | Ekman | 2/187 |
| 3,015,104 | 1/1962 | Crosson et al. | 428/919 X |
| 3,069,796 | 12/1962 | Ruter | 428/919 X |
| 3,673,056 | 6/1972 | Nadler | 428/17 |

*Primary Examiner*—Peter Nerbun

*Attorney, Agent, or Firm*—J. G. Heimovics; D. S. Guttman

[57] ABSTRACT

A combat helmet cover and a method of making it. The cover provides an irregular grass-like silhouette for the helmet that eliminates both the shine and glare of the helmet and the telltale smooth lines of the helmet. The base fabric is preferably a colored elastic or power net material, such as one consisting of about 80% nylon and 20% spandex. Attached to the base fabric are grass-like silhouette disrupter elements formed by bands of flexible material, at least one edge of which has a plurality of blade-like fingers extending therefrom which curl and assume different shapes. The dimensions of adjacent fingers vary irregularly in a grass-like pattern; the grass-like pattern can be achieved by quantizing the dimensions of the fingers and then randomly selecting the dimensions of each. A variety of distribution patterns for the disrupter elements upon the base fabric are presented.

12 Claims, 12 Drawing Figures

SNAGPROOF HELMUT CAMOUFLAGE COVER

BACKGROUND

The individual combat soldier wears a steel helmet as a piece of personal protective equipment. It is designed to protect him from flying projectiles, fragments, and debris. Unfortunately, its relatively smooth and round shape tends to create glint at certain sun angles and provides an unnatural domed silhouette which aids in its detection. The overhanging helmet also casts an undesirable shadow about the neck and lower head area under certain lighting conditions.

Many remedies for these signature problems have been proposed and tested. The most widely used has been a mesh netting stretched over the helmet. Twigs, leaves, and grass are inserted between the netting and the helmet to serve as camouflage.

Helmet covers have also been used which are simply pattern painted cloth covers, for example MIL-C-17502C, 12/30/71, Cover, Helmet, Camouflage. But these do not disrupt the helmet silhouette and can fade and become smooth and shiny after being washed several times.

Incised camouflage cloth, such as is used in netting for field artillery pieces, has also been used to cover helmets (See U.S. Pat. No. 2,911,652), but openings in this type of cover can snag on vegetation.

At least on an experimental basis, helmets have been flocked to add extra texture to the otherwise smooth steel surface, but in rough usage, such as when the helmet is used as a hammer, the flocking can come off in spots.

The primary function of the helmet cover is to disrupt the smooth round profile of the helmet and to scatter light rays so that glint is not produced. This must be accomplished without incurring the many incidental problems which can prevent the helmet cover from being used. Problems of this nature include too much trouble to carry because of bulk, too difficult to install on the helmet, failure to stay in place; also, the presence of a helmet cover should not be a noise generator, such as stiff fabrics or brittle vegetation. (See U.S. Pat. No. 3,015,104).

OBJECTS OF THE INVENTION

It is an object of this invention to provide a new camouflage helmet cover that has light scattering characteristics and the rough silhouette of natural vegetation without the disadvantage of being subject to snagging on field vegetation.

Another object of this invention is to make a camouflage helmet cover that is extremely easy to apply and elastically fits a variety of helmet shapes.

A further object of this invention is to provide a superior fabric base for such a cover, that is highly resistant to tears, strong enough to securely hold the disrupter elements and elastic enough to fit and retain itself upon a variety of helmets of different size.

A still further object of this invention is to create a new type of helmet garnish or silhouette disrupter that will simulate natural foliage and can be applied in a variety of patterns on a cover fabric base.

Yet another object of this invention is to create silhouette disrupter elements that have the random widths and lengths of natural vegetation to enhance their camouflaging effect.

Yet another object of this invention is to provide disrupter elements for attaching to helmet covers which can be attached in a simple manner without sacrificing the advantages of a highly irregular pattern.

Still a further object of this invention is to define a material suitable for fabricating a garnish or silhouette disrupter that has light scattering capability and three dimensional shape retention characteristic, will be durable in the field, resistant to mildew and fungus, and have a low moisture absorption relative to natural fibers.

Other objects of this invention, such as the provision of material that can be readily colored or dyed to match natural vegetation and will not fade in the field, will become more readily apparent as the details of the invention are described below.

SUMMARY OF THE INVENTION

The helmet cover aspect of this invention includes an elastomeric foundation fabric which stretches over the helmet and serves as a base for the attachment of disruptive material, such as a power net material having no loops or surface discontinuities exposed for snagging. Three dimensional grass-like disruptive elements are attached to the base fabric in a preselected pattern.

The disruptive elements of the invention are strips of low reflectance material having at least one irregular edge of finger or blade-like portions extending therefrom and curling irregularly to produce a grass-like appearance. A pattern for attaching the disruptive elements to the base fabric is suggested that flattens off the top of the helmet's dome silhouette and breaks the lower edge and linear shadow of the helmet. This pattern also includes crosswise disruptive elements which add to the helmet's irregular profile and concentrate disruptive elements in the front, which is considered desirable.

Four pairs of buttonholes may be provided in the base fabric to provide the field option of adding indigenous foliage such as straw, twigs, leafy branches, etc., and a dome cutout provided to reduce wear on the helmet cover when the helmet is resting on its top and also permit insertions of natural foliage.

Advantages achieved by the invention are:

(a) the helmet cover is elastically self retaining upon the helmet.

(b) the cover is rugged and highly snag resistant.

(c) the three dimensional grass-like pattern provides greater blending ability over prior art.

(d) cover is complete as manufactured so that wearer need not add indigenous foliage, which although sometimes helpful, may be cumbersome and noisy.

(e) the above advantages are achieved by a structure that creates very little noise when brushed against an object, and notably less than natural foliage in most instances.

DETAILED DESCRIPTION OF THE DRAWINGS

Figure 1:
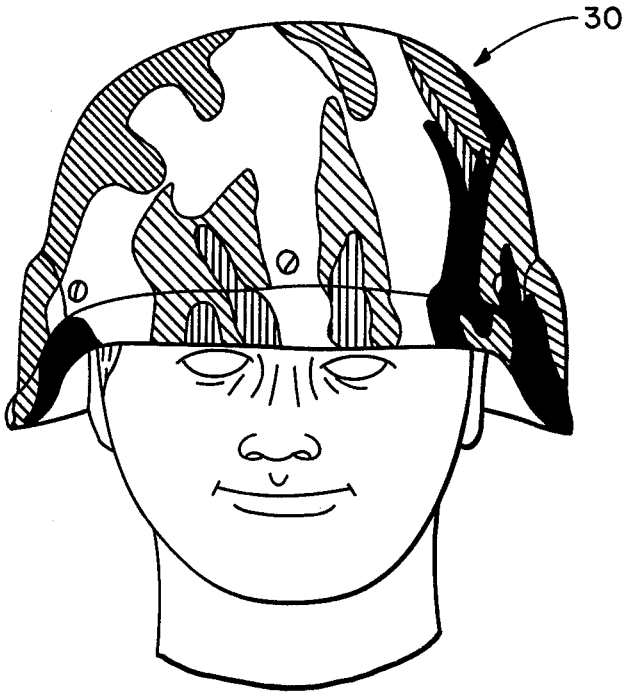
PRIOR ART FIG. 1
FIG. 1 which is a front view of a soldier wearing a helmet covered by a prior art multicolored canvas camouflage cover.
Figure 4:
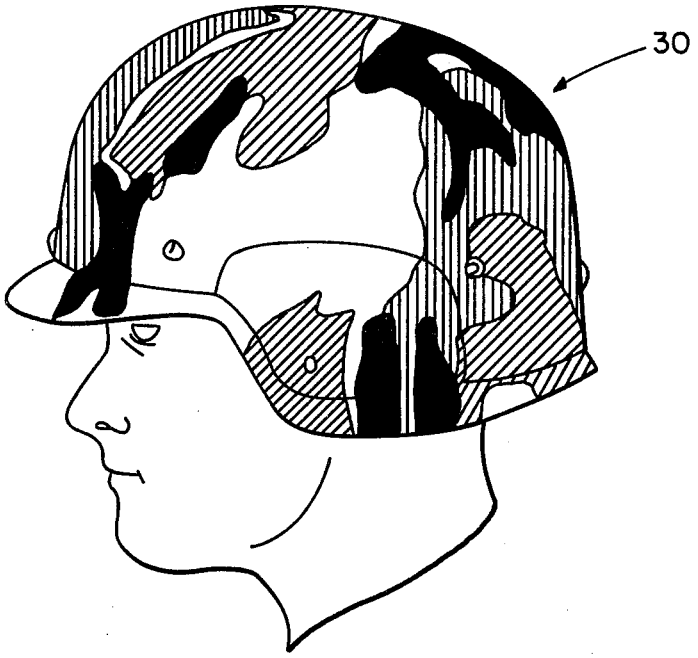
PRIOR ART FIG. 4
FIG. 4 is a side view of the prior art helmet of FIG. 1.

FIGS. 1 and 4 show, in front and from the side, a soldier wearing a prior art combat helmet cover of cloth having an irregular, multicolored pattern. While such a cover may reduce the glare and shine of the helmet in sunlight, it does nothing to conceal the telltale unnatural domed silhouette of the helmet or break up the shadow pattern that the helmet may cast about the wearer's neck and lower head area under certain lighting conditions.

Figure 2:
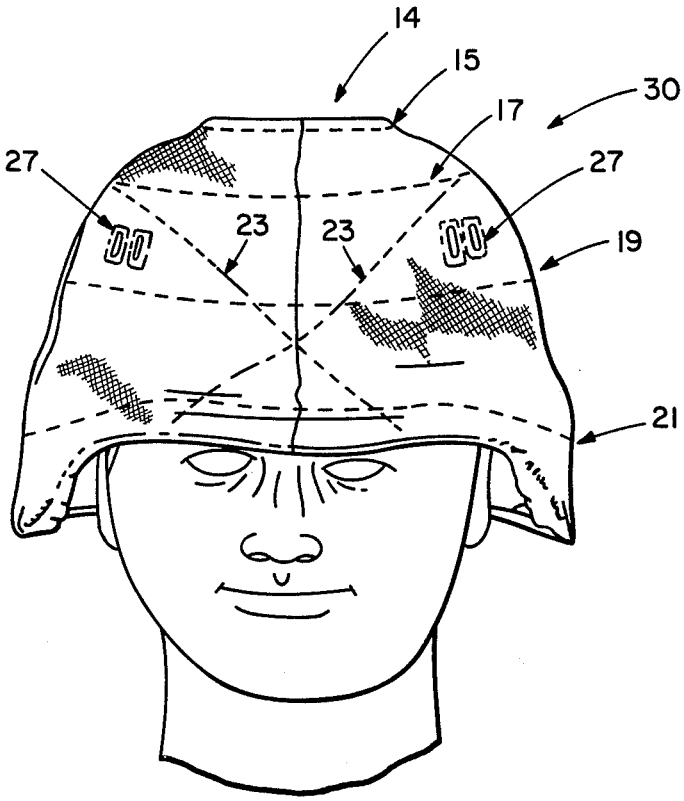
FIG. 2 is a front view of a soldier wearing a helmet covered by the base fabric stretch cover of the invention.
Figure 5:
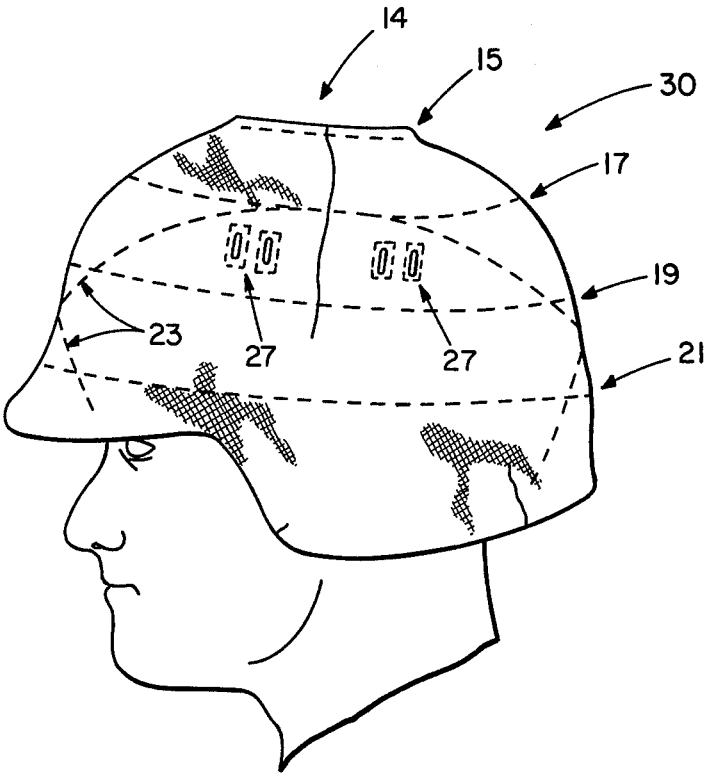
FIG. 5 is a side view of the helmet with base cover of FIG. 2.

FIGS. 2 and 5 show, from the front and side respectively, the base fabric cover 30 of the invention fitted upon a helmet. The garnish or disrupter elements have not yet been attached. The helmet cover 30 does not completely cover the helmet, but leaves uncovered a circular area 14 at the top to reduce wear and tear on the helmet cover when the helmet is set down upside down or is used, as it sometimes is, as a hammer.

Figure 3:
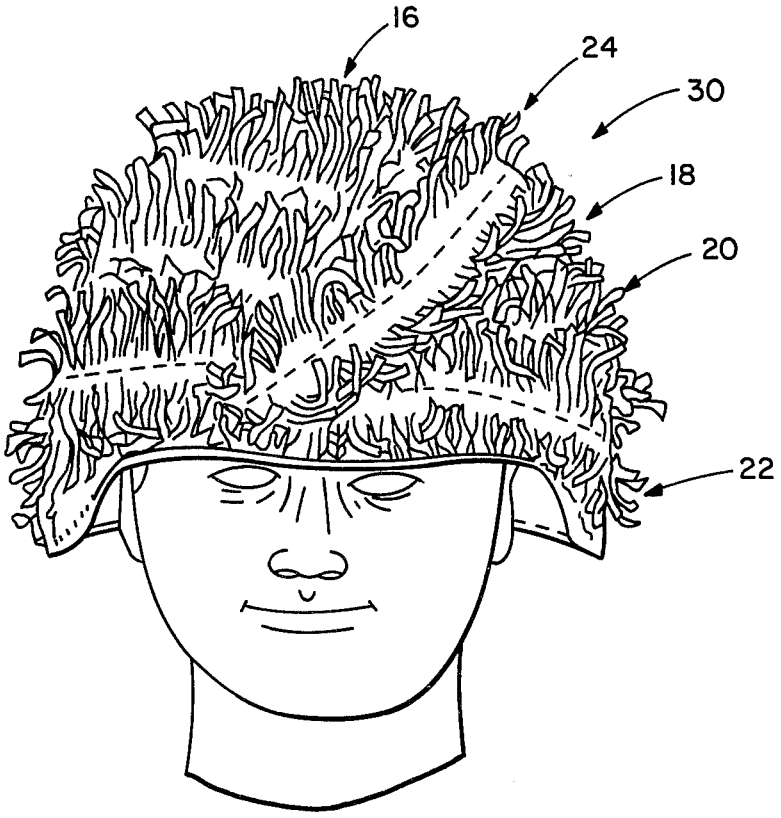
FIG. 3 shows the helmet cover of FIG. 2 with disruptive elements of the invention attached.

In FIG. 2, dotted lines 15, 17, 19, and 21 mark the lines along which the disrupter elements of the invention are to be attached. In FIG. 3, disrupter elements 16, 18, 20, and 22, are illustrated after being attached along the aforementioned dotted lines.

Figure 6:
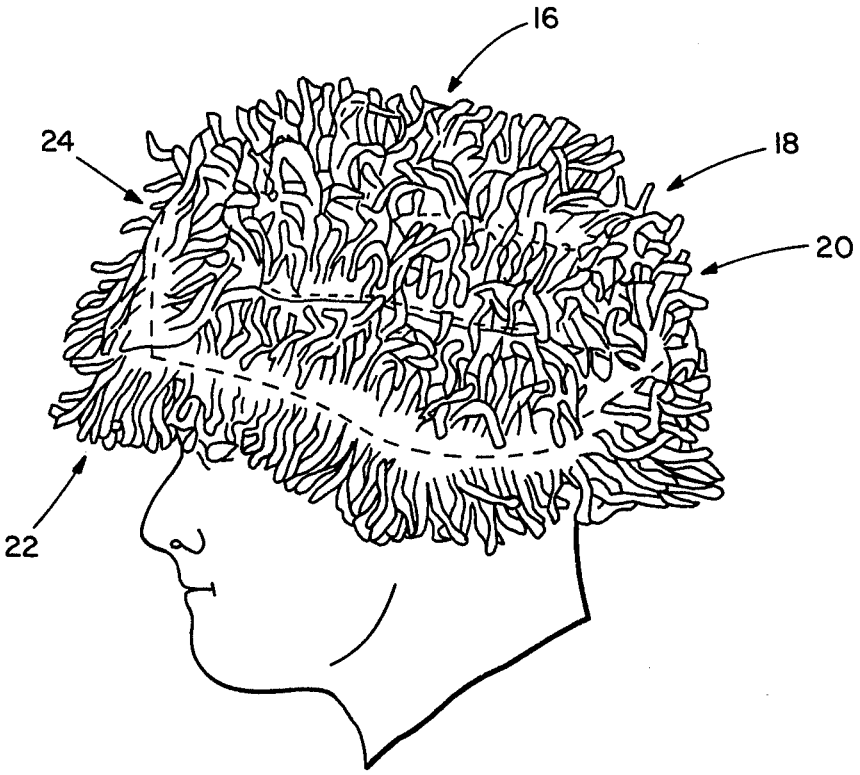
FIG. 6 is a side view of the completed helmet cover of the invention shown in FIG. 3.

An additional feature of this cover is the addition of an "X" or cross arc of disrupter elements 24 along lines 23 as illustrated in FIGS. 3 and 6. These "X" elements add to the irregular profile of the cover and concentrate the disruptive elements in front and back of the helmet, which is desirable.

Another feature of the invention visible in FIGS. 2 and 5 are buttonholes provided in the base fabric so that twigs and natural foliage can be inserted by the wearer. Similarly, twigs and natural foliage can be inserted in the top opening 14 of the cover.

I have found that it is very advantageous to use as a base fabric a so called "power net" material, which stretches in all directions; made of approximately 80% nylon and 20% spandex. This was selected over a double knit polyester and a rubberized stretch bandage fabric for its superior wearing characteristics and durability. A cover made from such a flexible base fabric can be fabricated to elastically retain itself upon the helmet with a minimum of wrinkling and fit a variety of helmet shapes.

A particularly suitable base fabric that is commercially available is J. P. Stevens fabric style K16655, which is 83% nylon and 17% lycra spandex. This is a two-way power net which possesses suitable bi-directional stretch and can be dyed to blend in with a desert, woodland or arctic environment.

Figure 12:
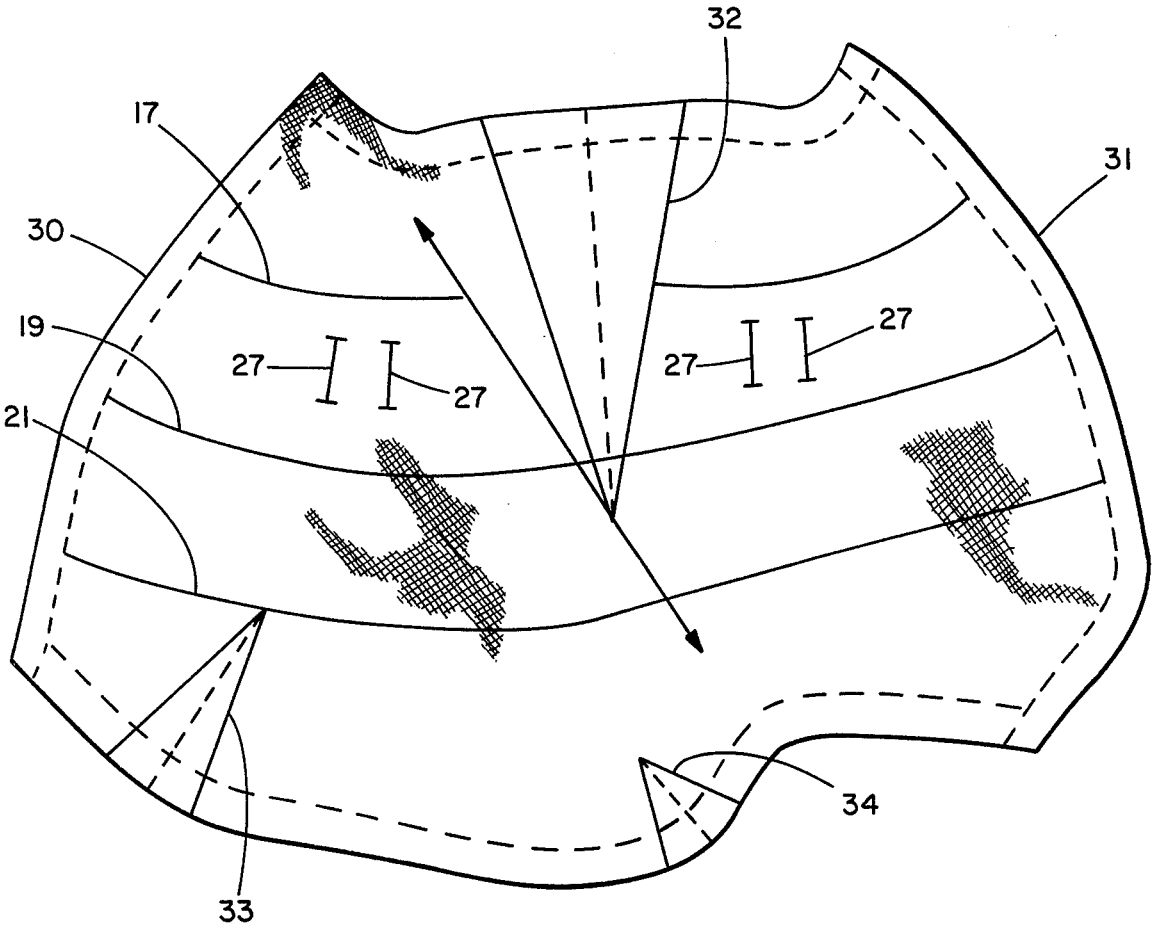
FIG. 12 is a scaled down pattern for a base fabric helmet cover of the invention.

FIG. 12 is a scaled down pattern for one half of the cover. Two such identical halves are sewn together along the matching sides 30 and 31 of each to form the cover leaving openings at the top 14 and bottom. The lines 17, 19, and 21 indicate where disrupter elements are to be attached. "Darts" 32, 33, and 34 are sewn in during assembly to give the cover the general shape of the helmet and provide an inward curling of the bottom edge which serves to hold the cover on the helmet. Button holes 27 are cut and sewn in a conventional manner. The pattern illustrated has been tailored to a U.S. Army helmet in the usual manner with the object of eliminating wrinkles.

It was somewhat of a challenge to find the right material and method of constructing the disrupter elements which serve as a garnish. Polyethylene was rejected as too noisy and shiny. Mylar material also proved too noisy to make a satisfactory garnish, and the same problem was found with reinforced paper, which also was probably not suitably weatherproof.

Figure 7:
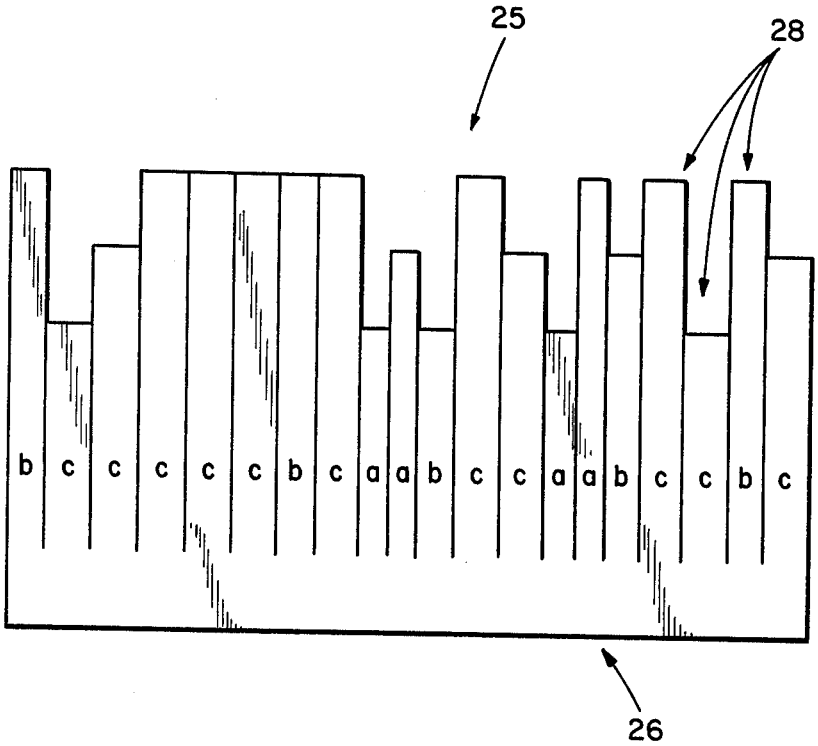
FIG. 7 is a drawing of a pattern for a disruptive element of the invention as applied to a longitudinally folded element.
Figure 8:
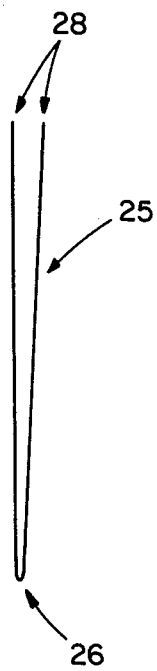
FIG. 8 is an end view of a disruptive element of the invention folded as in FIG. 7.

I have found that spunbonded polypropylene is particularly suitable for disrupter elements. A common variety commercially available is DuPont Typar TM style 3201. This material has an open non-reflecting structure and after being cut into disrupter elements is quiet when raked with the hand. The character of this material is such that upon being cut as shown in FIG. 7, spray painted and then oven dried the resulting blades 28 will curl in varying degrees to form a random grass-like fringe. It is reasoned that this curling may be attributed to the surface tension created by the paint, but may also be due in part to the random fiber structure of the material. The three dimensional character of the disrupter strips is enhanced when they are attached to the convex surface of the basic helmet cover. Lastly, this material has sufficient resilience to maintain its curl, but has a low enough modulus so that it is easily deflected without creation of significant noise. Acceptable coloring of the material has been obtained by spray painting with a lusterless camouflage paint; and the porosity of the material contributes to its light diffusing capability.

Referring to FIG. 7, an irregular, grass-like disrupter element (see 24 FIG. 3) can be made by laterally cutting the edge of a folded band 25 of the spunbonded polypropylene to achieve long, grass-like blades 28 on edges of the band. It is particularly convenient to fold the band in half, as illustrated in FIG. 7 where the fold is at 26, and cut the blades 28 in the top and bottom lateral edges of the band at the same time.

To achieve a natural, irregular appearance of the disrupter elements I decided to cut the blades in 3 widths, for example 3/16, ¼, and 5/16 of an inch, and 3 different lengths, for example 2, 2½, and 3 inches. Actual selection of the pattern of widths and lengths can be made by a random process, giving the typical results such as shown in FIG. 7. Once suitably randomly selected lengths of garnish have been designed by such a random process, they could be fabricated in quantity by the use of dies or other conventional processes.

The length of the blades 28 and width of the band 25 may vary, but I have found a band width of about 6 inches to be a convenient size when used with the set of blade widths and lengths given above.

Figure 9:
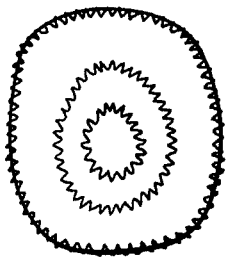
FIG. 9 is a suggested pattern for the camouflage cover of the invention in which the disruptive elements have been attached in a circular pattern.
Figure 10:
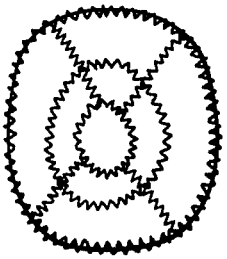
FIG. 10 is similar to FIG. 9, but the pattern of disruptive elements has been enhanced by the addition of "X" or cross elements to give further irregularity and vegetation like appearance to the helmet cover.
Figure 11:
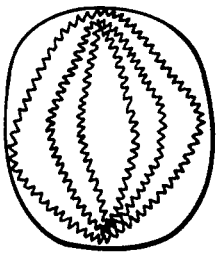
FIG. 11 is similar to FIG. 9 wherein the disrupter elements run across the helmet in selected arcs.

The disrupter elements may be stitched to the base fabric at the location shown in FIGS. 2 and 5 by dotted lines 15, 17, 19, 21, and 23 to achieve the grass-like covering shown in FIGS. 3 and 6. Other suitable configurations are shown in FIGS. 9, 10, and 11, and other patterns are possible, though probably not necessary because the disrupters of the design inherently give an irregular silhouette.

It will be readily apparent to those skilled in the art that the garnishes or disruptive elements of the invention might be applied in other camouflage situations to give an irregular silhouette to equipment, shelters, etc., covered by a base fabric to which they can be attached. In such other applications the size of the disruptive elements and the number of quantized dimensions might be varied appropriately to achieve simulation of various foliages.

While what has been shown and described above is now thought to be a preferred embodiment of the invention, it should be understood that the invention could take other forms and expressions. Consequently, the invention should not be considered as limited to the precise structure shown and described above, but rather the full scope of the invention is set forth below in the claims.

What is claimed is:

1. A camouflage disrupter element comprising (a) a band of flexible material having a top and a bottom lateral edge, (b) a plurality of substantially snagproof blade-like elements extending from both lateral edges of said band in random direction forming a downward extending and an upward extending three dimensional grass-like pattern, and (c) said blade-like elements being resilient and capable of substantial recovery of shape upon being disarranged.

2. The disrupter element of claim 1 wherein the length and width of said blade-like elements are varied so as to form an irregular pattern.

3. The disrupter element of claim 1 wherein the dimensions of the blade-like elements are quantized and randomly selected.

4. The disrupter element of claim 1 wherein the band is made of a spunbonded polypropylene.

5. A method of making a substantially snagproof camouflage disrupter element comprising the steps of:

(a) providing a folded band of flexible material having two top lateral edge and a bottom lateral edge, (b) cutting simultaneously laterally into both of said top lateral edges at selected points along said top edges so as to form a plurality of blade-like elements of varying widths, (c) trimming the ends of said elements to achieve a plurality of selected lengths, and (d) unfolding the band so the blade-like elements point both up and down.

6. A camouflage cover for a helmet comprising:

(a) a base fabric cover shaped to fit over and closely adhere to the helmet;

(b) a plurality of substantially snagproof grass-like disrupter elements attached in a pre-selected pattern to the base cover, each disrupter element comprising:

(1) a band of flexible material having a top lateral edge and a bottom lateral edge; and (2) a plurality of curled blade-like elements extending from both of said lateral edges, the height dimension and width dimension of said elements varying in a grass-like pattern; and (c) a portion of said blade-like elements extending downward over the lower edge of the helmet when said cover is fitted thereon.

7. The cover of claim 6 wherein the fabric of said base cover is a power net material.

8. The cover of claim 7 wherein the base fabric is approximately 80% nylon and 20% spandex.

9. A method of making a substantially snagproof camouflage cover for a helmet, the method comprising the steps of:

(a) providing a base fabric cover configured to closely fit over and attach to the helmet;

(b) providing a plurality of disrupter elements comprising bands of flexible material, each band having a plurality of grass blade-like elements extending outwardly and transversely therefrom in a three dimensional pattern;

(c) attaching the disrupter elements in a selected pattern pointing the blade-like elements both up and down over the base fabric so to obscure the outline thereof.

10. A substantially snagproof camouflage cover for a military helmet comprising:

(a) a base cover of elastomeric material contoured to fit over the helmet, the lower edge of said cover having a perimeter smaller than the perimeter of the helmet edge so as to retain itself on the helmet upon being stretched thereon;

(b) a plurality of disrupter elements attached to said base cover, each comprising a band of material with a multiplicity of grass blade-like elements extending outwardly and transversely therefrom in an irregular three dimensional pattern, said blade elements being integral with said band, and formed by a plurality of lateral cuts into a top and a bottom edge of said band, and of a plurality of selected lengths.

11. The helmet cover of claim 10 wherein said disrupter elements are placed upon said cover with said blade-like elements extending downward below the lower edge of the helmet so as to break the shadow line thereof, and are grouped around the crown of the helmet so as to give the helmet a generally squared off appearance.

12. In the cover of claim 6 the further improvement that the disrupter elements are attached on the base cover in a pattern selected from the group of patterns shown in FIGS. 9–11.

* * * * *